US007731251B2

(12) United States Patent
Ye

(10) Patent No.: US 7,731,251 B2
(45) Date of Patent: Jun. 8, 2010

(54) COMPACT SLIDING SASH LOCK

(76) Inventor: Jintian Ye, 4507 Little John St., Baldwin Park, CA (US) 91706

( * ) Notice: Subject to any disclaimer, the term of this patent is extended or adjusted under 35 U.S.C. 154(b) by 154 days.

(21) Appl. No.: 11/986,192

(22) Filed: Nov. 20, 2007

(65) Prior Publication Data

US 2009/0127872 A1 May 21, 2009

(51) Int. Cl.
*E05C 1/08* (2006.01)

(52) U.S. Cl. ..... 292/163; 292/170; 292/DIG. 20; 292/DIG. 47

(58) Field of Classification Search ..... 292/163, 292/164, 170 X, 169.18, 302, DIG. 20 X, 292/DIG. 26, DIG. 35, DIG. 33, DIG. 37, 292/DIG. 40, DIG. 47 X; 49/181, 175, 182, 49/449

See application file for complete search history.

(56) References Cited

U.S. PATENT DOCUMENTS 6,669,047 B2 * 12/2003 Wooderson et al. ..... 220/316
6,846,025 B2 * 1/2005 Sclater et al. ..... 292/336.3
7,118,142 B2 * 10/2006 Xu ..... 292/139
7,165,791 B2 * 1/2007 Rebel et al. ..... 292/137
7,407,199 B2 * 8/2008 Richardson ..... 292/163
2008/0179896 A1 * 7/2008 Chung ..... 292/164

* cited by examiner

*Primary Examiner*—Peter M. Cuomo
*Assistant Examiner*—Mark Williams
(74) *Attorney, Agent, or Firm*—Clement Cheng

(57) ABSTRACT

A sash lock for use with door and window is provided. The lock has a base housing shaped into a laterally extending crib to contain a partially protruding plunger sliding under a forward bias, a large button block that occupies a substantial area at the top of the lock to allow for a unique squeeze release of the plunger and translates in a perpendicular plane with respect to the plunger movement under an expansive bias for normally pushing the button block away from the base housing in cooperation with the biased counteraction of the cam surfaces of the plunger but yielding to a manual depression to activate the plunger through a cam engagement, and a top housing fastened to the base housing to enclose the plunger and button block. The plunger has cam surfaces at a rear end facing forwardly and a beveled lip portion at a front end while the button block has a beveled surface facing the cam surfaces of the plunger. The sash lock further comprises two identical holes formed in the bottom of base housing and a separate keeper for interlocking with the base housing.

10 Claims, 5 Drawing Sheets

COMPACT SLIDING SASH LOCK

BACKGROUND OF THE INVENTION

A. Field of the Invention

The present invention relates to door and window hardware. More particularly, the present invention relates to a mechanically stable and ergonomically improved door and window sash lock.

B. Description of the Prior Art

Sliding windows or patio doors in a building are made for letting in necessary light and air into the room while allowing occupants to have a comfortable viewing of the surrounding nature. At the same time, such doors or windows should be able to lock out harmful elements and potential intruders.

Window latches and locks that are also applied to doors have been developed as the windows in the modernized buildings have long been evolved all together. Of different types of slider window, a single-hung type window is structured to have an upper outside pane in a stationary sash and an inside pane in a sliding sash guided in a window frame along its vertical path between a raised level positioned over the upper sash to half open the window and a lowered position to close the window opening in cooperation with the upper sash. A double-hung type window has two vertically sliding sashes movable in parallel planar paths in a single frame. There are also horizontal sliders. A gliding window has two sashes with at least one sliding horizontally past the other. The respective sashes of the double-hung windows may be made to swing inwardly for the purpose of a safe cleaning but they must be returned to their vertical abutting positions when the window is to be locked. Normally, in the closed position, the mating sashes have the respective proximal sides overlapped to offer the necessary sealing. Therefore, most latches are conveniently positioned near the meeting areas of the two sashes at the exposed surface of the inner sash while the mating keeper or strike is fixed to the accompanying outer sash.

Known latches for windows have their inherent drawbacks. Automatic window sash locks as depicted in U.S. design Pat. No. 395,222 to Fountaine comprise a main latch body attached to a slide-open sash for automatically engaging a fixed keeper on the companion sash or the sash itself that incorporates in its profile a notch so that the sashes are immobilized in the frame when the window is closed. Such sash locks generally include a user-operated component handle to release the automatic locking mechanism, which only needed the sliding closure of the sash to push in a bolt of the sash lock before it protrudes back into engagement with the keeper or notch. To streamline the one-handed user operation in lift or sideway slide opening of the window, the release handle or lever of the sash locks is adapted to be depressed by index to little fingers while the thumb presses on the underside of the proximal sash part to release the lock and slide the sash in one action.

However, the lever needs a substantial projection from the main latch body taking up space upward as well as toward the user for the bolt to create a proper lever or bolt action inside the latch device. This makes a bulky and unappealing lock structure that sticks into the viewing area of glass panes. Under the superficial problem lies a mechanical disadvantage to have to apply a large circular force to retract a locking bolt out of engagement with the counterpart of the other sash. For the internal actuator to move the bolt easily, the lever must extend above and beyond the latch device itself as long as possible. However, such deflecting lever movements produce a long-term adverse force against the secure joint between the latch device and sash during their combined lifetime because normally there is only a couple of fasteners to endure the releasing depressions at repeated window openings.

Hence, there is need for a small form factor sash lock that is not only visually unobtrusive but also mechanically stable and ergonomically fit.

SUMMARY OF THE INVENTION

In view of the foregoing, the object of the preset invention is to provide a compact sash lock that locks automatically and is squeezable directly over almost its entire body to actuate the release mechanism requiring no defecting actuators or handles.

Another object of the present invention is to provide a fail-safe locking mechanism for door and window sashes which is easy to manufacture.

A sash lock of the present invention is for use with door and window sashes and it has a base housing having an elongated planar bottom with two tubular posts located near further lateral ends of the bottom to support fasteners for mounting the sash lock on a first inner sash member sliding in relation to a second outer sash member. Around the bottom of base housing an upright front wall with an elongated aperture and connecting side and rear walls encircle and a supporting topography is integrally formed inside of the walls.

A plunger is slidably supported in the base housing to move linearly under a forward bias and has cam surfaces at a rear end facing forwardly and a beveled lip portion at a front end protruding through the front aperture of the base housing.

A large button block extends laterally over the tubular posts of the base housing and has a beveled surface facing the cam surfaces of the plunger and two opposite end tunnels to fit snugly over the tubular posts for maintaining linear translations perpendicular to the moving direction of the plunger under an expansive bias for normally pushing the button block away from the base housing in cooperation with the biased counteraction of the cam surfaces of the plunger. The button block has a height greater than that of the surrounding walls of base housing. Then, a top housing is fastened to the base housing to enclose the plunger and button block allowing them to move within the respective ranges of translation.

The sash lock further comprises two identical holes formed in the bottom of base housing at both sides of the aperture and a separate keeper for mounting on the second outer sash member. The keeper has a strike plate that extends in parallel with the front wall of base housing when it is mounted on the outer sash member, a beveled surface at a distal edge of the strike plate to face the beveled lip portion of the plunger, two opposite legs at a proximal edge of the plate to define a large rectangular notch into which the plunger protrudes, an L-shaped bracket joined to distal ends of the legs for supporting fasteners threaded though the second sash member and a double catch shaped to hook in the two bottom holes of the base housing as the plunger rides over the strike plate at the meeting of their beveled surfaces. Therefore, the lock can make a complete three dimensional locking engagement with the keeper until an inside occupant of the inner sash member gently grabs the inner sash and the button together to release the plunger and start sliding the sash at the same time.

The forward bias of the plunger and the perpendicular expansive bias of the button block are produced by two pairs of identical helical springs held in the respective positions at first ends by topographic peaks and valleys of the base housing and complementary protrusions of the top housing and at the opposite second ends through insertion into slots formed in the plunger and the button block to keep a balanced actuation of the button block and plunger.

The plunger is kept in fore and apt translations in one plane by two side upright walls from the base housing and in another perpendicular plane by a flat area of the base housing bottom and complementary guide plates from the top housing.

Embodiments of the invention will now be described by way of example with reference to the accompanying drawings.

BRIEF DESCRIPTION OF THE DRAWINGS

Similar reference numbers denote corresponding features throughout the attached drawings.

16 Upper Sash
12 Window
38 Glass Pane
34 Beveled Surface
10 Sash Lock
22 Button
11 Latch Unit
36 Double Catch
14 Lower Sash
20 Seal
42 Lip
24 Meeting Rail
44 U-Shaped Interlock
24 Groove
94 Screw
82 Upper Housing
88 Mounting Post
90 Vertical Tunnel
50 Base Housing
92 Guiding Post
86 Assembly Screw
26 Plunger
132 Strike Plate
134 Leg
32 Keeper
140 Screw Slot
136 Notch
138L. Bracket Portion
112 Bump
102 Push Blade
108 Tip
99 Block Section
100 Blind Hole
91 End Leg
54 Upright Wall
74 Beveled Surface
62 Lip Portion
68 Aperture
64 Stop
70 Hole
66 Front Wall
84 Screw Hole
52 Bottom
128 Sidewall
50 Base Housing
96 Spring
76 Spring
80 Block
98 Column
130 Rear Wall
82 Upper Housing
188 Recessed Wall
106 Opening
126 Lip
122 Guide Plate
60 Cam Surface
58 Foot
124 Stake
120 Recessed Wall
116 Bump
140 Screw Slot

DETAILED DESCRIPTION OF THE PREFERRED EMBODIMENT

Figure 1:
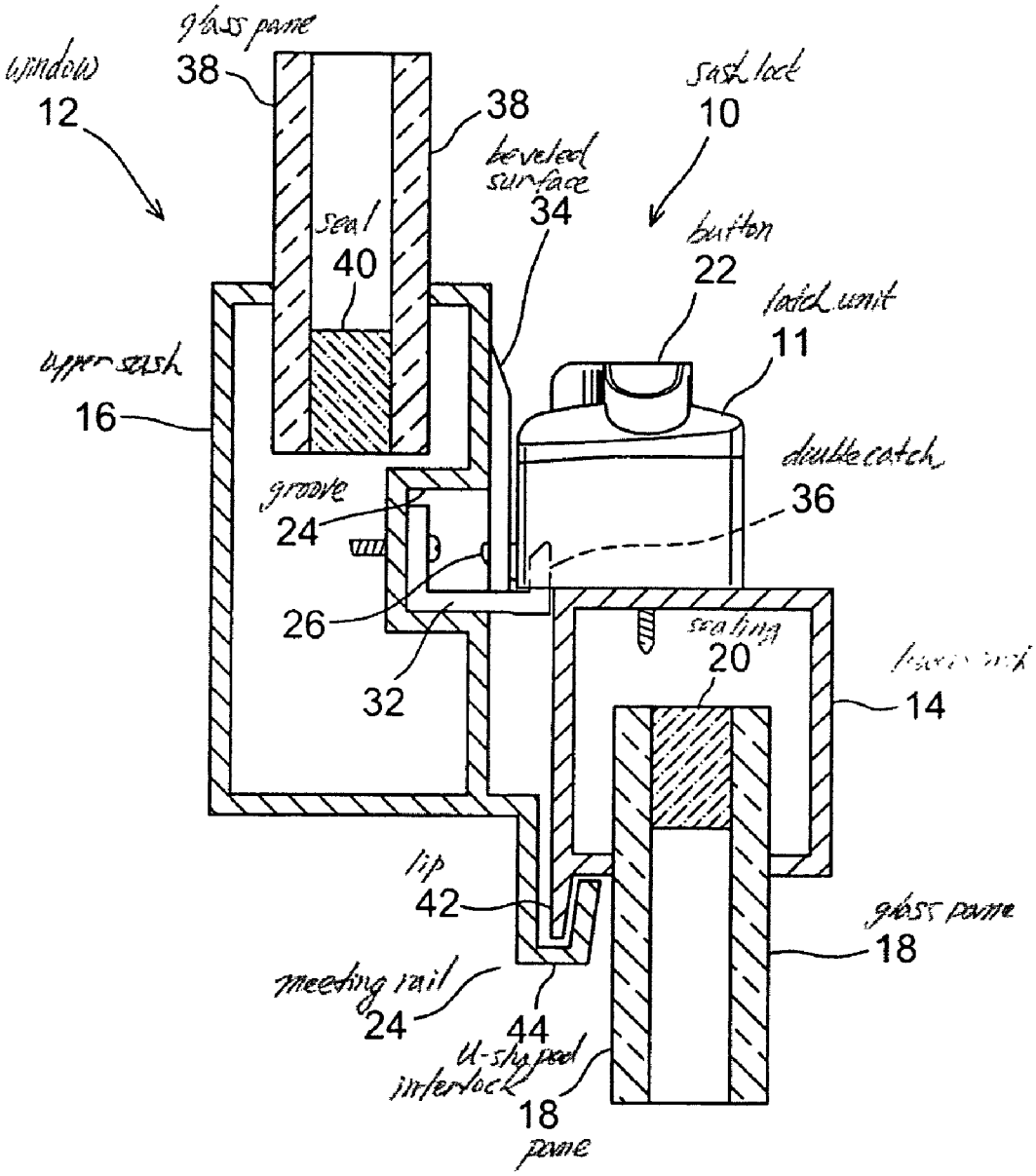
FIG. 1 is a side elevation view of a compact sash lock installed according to the present invention.

With reference to FIG. 1, a window lock assembly 10 of the present invention generally comprises a latch unit 11 and a keeper 32 and is made for a sliding window 12 that may includes a rectangular inner lower sash 14 shown at its top cross sectional area and a similarly shaped outer upper sash 16 shown at its bottom cross sectional area for mating with the lower sash 14 to close window 12 as the lower sash 14 slides over the upper sash 16 in a window frame (not shown). Lower sash 14 encases downwardly extending glass panes 18 and a sealing 20 between the panes 18. In the window 12 illustrated, latch unit 11 may be mounted on the top middle surface of lower sash 14.

Besides covering the interior room of a building from the elements, window 12 may obtain an improved security and aesthetic value from the sash lock 10 that may be installed initially at the time of building a house or home improvements wherein the owner may replace the old bulky locking devices with this mechanically reliable and yet more compact sash lock 10. With functionally and ergonomically advanced quality, the installed sash lock 10 will blend well with the surrounding window sashes and does not create a physical interference with handling the sashes in opening and closing the window while allowing an uninterrupted view due to its low and thin profile lodged within a small confinement between the two sashes 14 and 16. With the complete renovation from the known cam lock mechanisms, lock assembly 10 of the present invention has come to have no conventional deflected lever projection any more. Instead, it provides an oversized push button 22 to be depressed directly toward lower sash 14 in its longitudinal direction so that the user intuitively grabs button 22 together with the underlying sash 14 to lift the same in the normal course of opening the window 12. No extra manipulations to release sash lock 10 are necessary. Because button 22 is depressed within the area of latch unit 11 of the sash lock 10 and in direct alignment with lower sash 14 the attachment of latch unit 11 to sash 14 stays firm over long time.

Facing opposite to lower sash 14, the upper sash 16 has a horizontal upper groove 24 for receiving a spring-loaded plunger 26 of latch unit 11 through the interlocking keeper 32, which is affixed into groove 24 and provides a beveled surface 34 for interacting with plunger 26 and a double catch 36 for immobilizing latch unit 11 and lower sash 14 completely.

Upper sash 16 may be stationary encasing upwardly extending glass panes 38 and a sealing 40 between the panes 38 although mechanisms are known to inwardly swivel and/or slide up down both sashes 14 and 16. In the double-hung type window 12 illustrated, latch unit 11 may be mounted on the top middle surface of lower sash 14. Along the outer side of lower sash 14 extends a downward lip 42 for mating with a U-shaped interlock 44 of the meeting rails made of sashes 14 and 16 in order to provide the preliminary security as well as weather sealing. The plunger 26 may be made of zinc. The metallic plunger 26 has a hardness, which provides wear-resistance to the repeated engagement with keeper 32 or the upper sash 16 at the groove 24 in case keeper 32 is not present.

Figure 2:
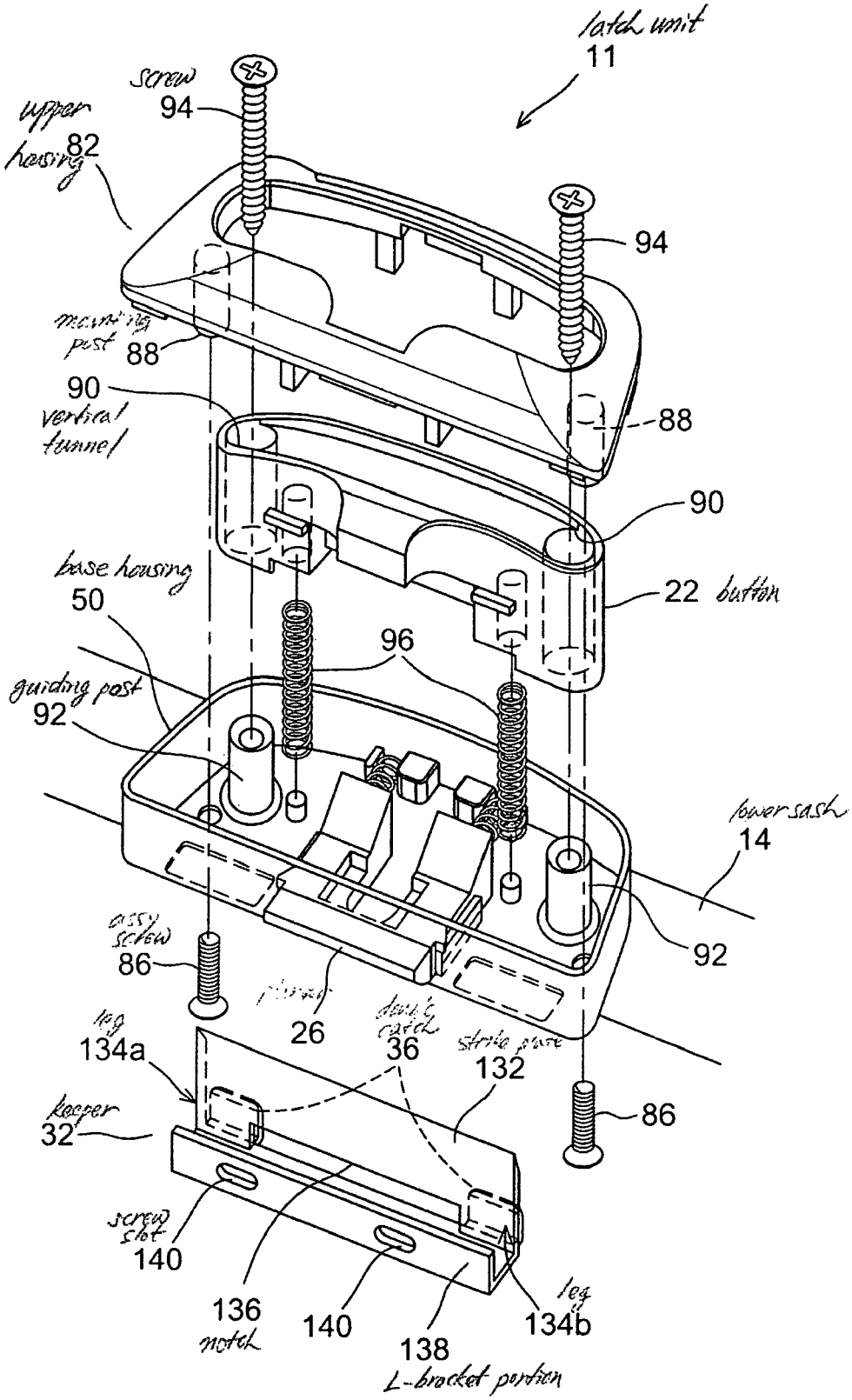
FIG. 2 is an exploded perspective view of the sash lock of FIG. 1 showing all of the components.

FIG. 2 depicts the overall construction of latch unit 11 and its interlocking keeper 32. A major component of latch unit 11 is a base housing 50 that may be made of a die-cast metal in the shape of a generally rectangular crib having various anchor means for holding moving parts in the latch unit 11.

Figure 3A:
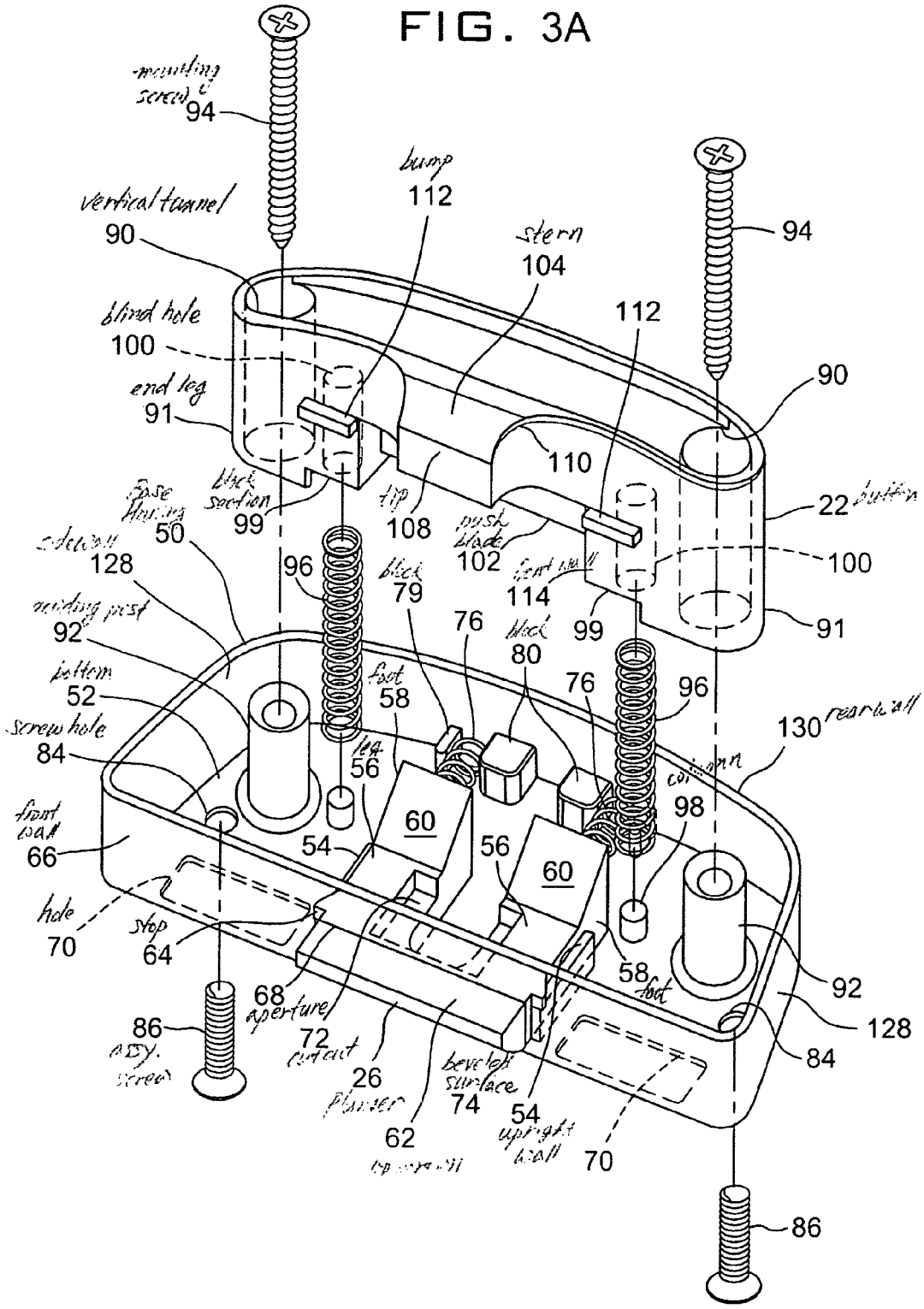
FIG. 3A is an enlarged perspective view of the latch unit with an upper housing removed to show in detail the positional relations of components within a base housing.

The housing 50 and the rest associated parts constituting latch unit 11 are formed symmetrical with reference to the frontal meridian line (not marked) of the unit 11 in order to keep balanced latching actions in cooperation with the similarly symmetrical keeper 32. Mounted on the bottom 52 of base housing 50 is the twin cam plunger 26 adapted to slide horizontally through housing 50 within a straight track formed by two side upright walls 54 distanced equally from the meridian line of unit 11 as better shown in FIG. 3A.

Plunger 26 is generally U-shaped with two legs 56 extending toward the interior of housing 50 and terminated by feet 58, respectively. Each of the feet 58 has a top cam face 60 to be actuated by a vertical downward depression to provide a retracted position of plunger 26. The feet 58 of plunger 26 are connected by a lip portion 62, which is movable between an extended position shown in FIG. 2 and the same retracted position of plunger 52. Extension of plunger 26 is limited by two opposite side stops 64 integrally formed to plunger 52 for abutment at the inner surface of a front upright wall 66 of housing 50. To allow the protrusion of lip portion 62, front wall 66 has a vertical rectangular aperture 68 centrally positioned. Identically formed in bottom 52 at both sides of aperture 68 are horizontal rectangular holes 70 for accepting vertical double catch 36 of keeper 32 to provide an omni-directional locking engagement between unit 11 and keeper 32 that is very difficult to break. In order to take advantage of double catch 36 combined with rectangular holes 70, latch unit 11 may be fastened to sash 14 slightly overhanging as illustrated in the drawings.

Figure 4:
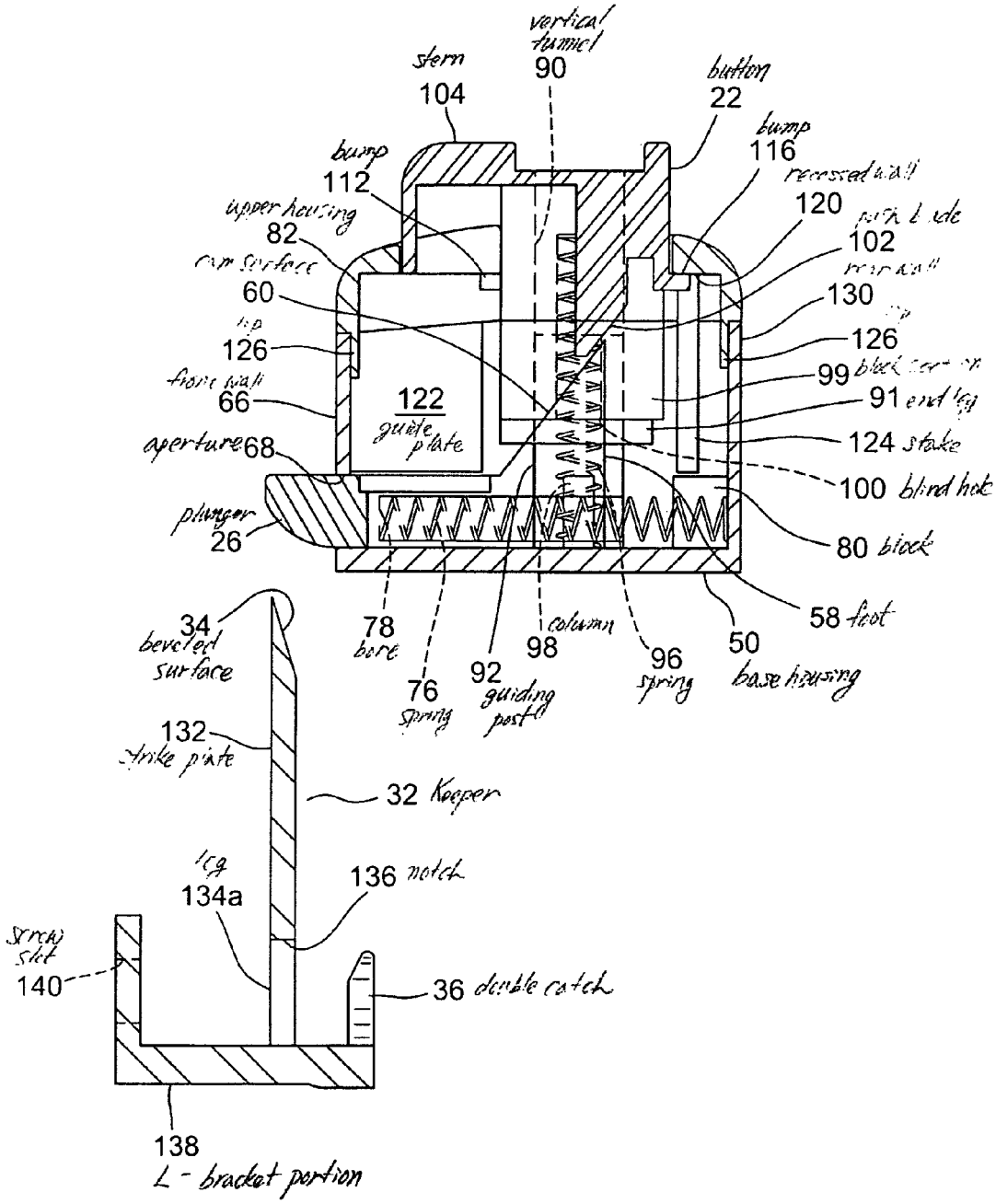
FIG. 4 is a cross sectional view along the frontal median lines of the keeper and latch unit of FIG. 2 after assembly.

The top surfaces of plunger 26 are flat save cam faces 60 and a selected cutout 72 that reduces the weight of plunger 26. Of the bottom surfaces of plunger 26, lip portion 62 has a beveled surface 74 around its lower front corner for cooperating with the corresponding surface of keeper 32. Then, two expansion springs 76 are inserted into the legs 56 through bores 78 that extend almost the length of the legs 56, respectively as shown in cross section in FIG. 4. The outer free ends of springs 76 are each kept in place by a couple of small blocks 79 and 80 formed integral to housing 50 at side-by-side positions. An upper housing 82 for closing base housing subsequently closes the top open space between blocks 79 and 80 as will be described below. Therefore, twin cam plunger 26 is always urged outwardly to protrude into engagement with keeper 32 when they slide into a meeting position.

In addition, two screw holes 84 are formed in bottom 52 near its lateral edges to permit two assembly screws 86 to be respectively driven up to downwardly extending mounting posts 88, which are integrally formed on upper housing 82 to permanently enclose the various components of latch unit 11 within a partially closed space between the two housing members 50 and 82.

The separately formed button 22 is responsible to activate plunger 26 by pushing back the cam faces 60. Button 22 may be made of a single metal block spanning almost the entire length of the housing 50 or 82. Button 22 is elongated laterally and relatively higher than wall 66 of base housing 50. In addition, button 22 has twin vertical tunnels 90 through its opposite end legs 91 for snuggly receiving two upright guiding posts 92 that double as screw supports for two mounting screws 94, which can be easily driven from above the completed sash lock 10 through posts 92 and then into lower sash 14. Each post 92 may have a funnel-shaped top surface to conform to the conical surface of screw 94 for a firm engagement.

At the same time, button 22 is held in a balanced posture by two upright suspension springs 96, which are anchored on round columns 98 formed on housing bottom 52 inwardly of guiding posts 92. The combined expansive force of springs 96 is determined to be just enough to counter the gravity at button 22 plus a relaxed exertion of manual push to ensure a pleasant manual actuation of button 22 as well as the uninterrupted automatic advancement of plunger 26 into the locking position by the horizontal plunger springs 76.

Button 22 also has left and right block sections 99 with respective blind holes 100 formed concentrically to columns 98 for holding upper portions of springs 96 so that springs 96 are secured between base housing 50 and button 22, which are always urged away from each other. Extending lengthwise underside of button 22 is a push blade 102 beveled for engaging both cam surfaces 60 at the same time to retract plunger 26 when button 22 is depressed.

Figure 3B:
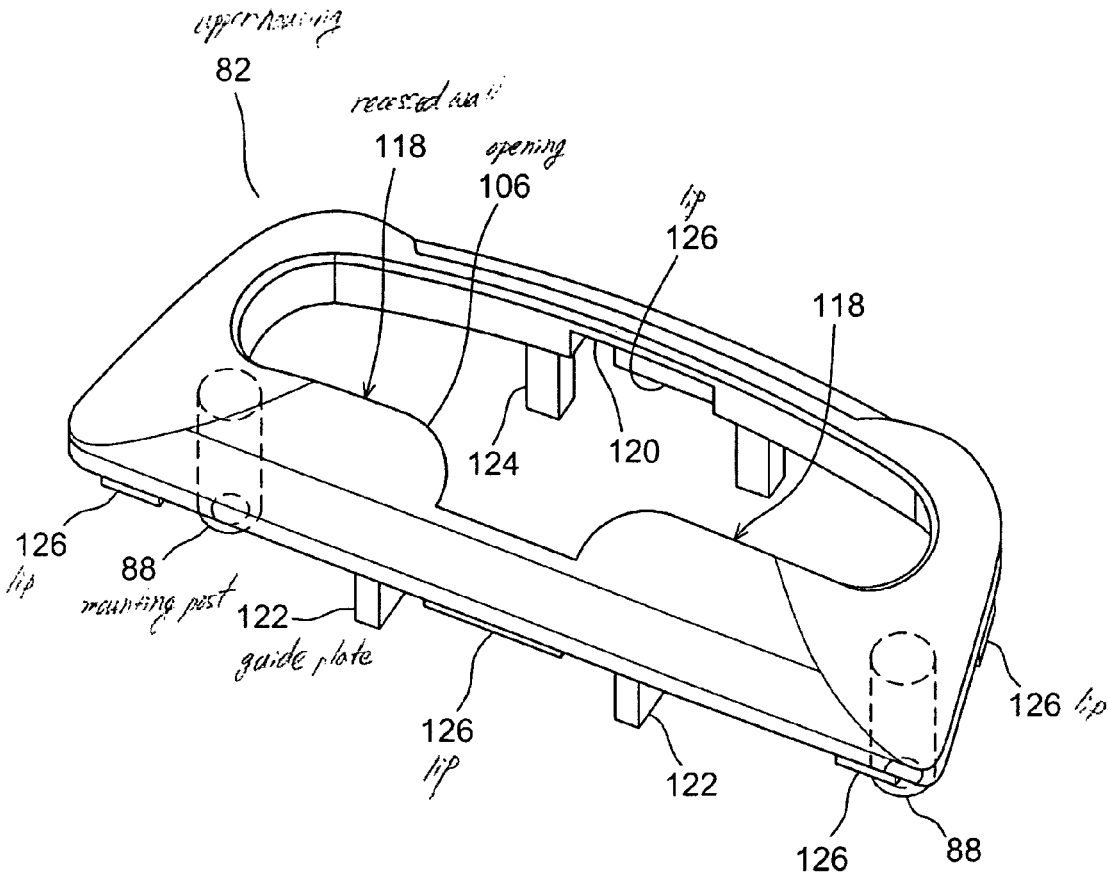
FIG. 3B is a perspective view of the upper housing to mate with and close the base housing.

Additionally, in the front middle area of button 22 there is formed a stern 104 that conveniently enlarges the area of button 22 to be contacted by the operator's hand and helps assist button 22 in maintaining its vertical translations along the guiding posts 92 as stem 104 keeps sliding contacts with upper housing 82 through its large opening 106 that conforms to the general circumferential profile of button 22 as shown in FIG. 3B. Stem 104 gradually converges and is bordered by a blunt tip 108 with round sides 110 that altogether extend vertically downwardly. Preferably, stem 104 is hollow to keep button 22 light.

Button 22 has two side bumps 112 on its front vertical walls 114 (FIG. 3A) and a similar middle bump 116 at its rear lower edge (FIG. 4) in order to limit its upward translation by abutting the respective recessed walls 118 formed on upper housing 82 near the front section of opening 106 and a similar recessed wall 120 located at the same height of walls 118 close to the rear middle section of opening 106.

The thus constructed button 22 can hold itself in the assembled position in base housing 50 while the respectively spring loaded plunger 26 and button 22 are both encased by upper housing 82, which is secured using the assembly screws 86. Depending from the bottom surfaces of button 22 are a pair of guide plates 122 for holding down legs 56 of plunger 26 and another pair of rear stakes 124 to run over springs 76 placed between the open blocks 79 and 80 to secure the distal ends of springs 76. In order to facilitate assembly of upper housing 82 onto base housing 50, upper housing 82 has an alignment means of discrete downward lips 126 along the lower peripheral surfaces to fit snugly in the interior of surrounding walls of base housing 50 which comprises front wall 66, two side walls 128 and a rear wall 130.

Keeper 32 comprises an upright strike plate 132 having beveled surface 34 at the top edge and two opposite legs 134*a*, 134*b* at the bottom to define a large rectangular notch 136 into which plunger 26 clicks to keep latch unit 11 in a locked position automatically after plunger 26 rides over strike plate 132 at the meeting of their beveled surfaces 74 and 34. Extending integrally from the bottom of strike plate 132 is an L-shaped bracket portion 138 with at least two screw slots 140 for fastening plate 132 to upper sash 16 shown in FIG. 1. Screw slots 140 are carefully positioned in bracket portion 138 to permit unobstructed access of fastening screws through notch 136 at installation.

The double catch 36 comprises two upturned hooks stemming from legs 134*a* and 134*b*. When latch unit 11 goes into the locked position, double catch 36 comes to penetrate into the holes 70 of base housing 50 in order to further lock the unit 11 and sash 14 horizontally over the primary vertical latching engagement of plunger 26. Therefore, latch unit 11 can make a complete three dimensional locking engagement with keeper 32 until an inside occupant of the window 12 gently grabs the lower sash 14 with button 22 to release plunger 26 and start sliding the sash 14 at the same time.

Therefore, while the presently preferred form of the sash lock has been shown and described, and several modifications thereof discussed, persons skilled in this art will readily appreciate that various additional changes and modifications may be made without departing from the spirit of the invention, as defined and differentiated by the following claims.

For example, as a matter of simply changing the orientation, the same sash lock 10 may be mounted to a laterally sliding sash door at the interior side following the illustrated mounting method in order to obtain the equally improved benefit of the present invention.

The invention claimed is:

1. A sash lock for use with door and window sashes comprising:

an inner sash member sliding in relation to a outer sash member, wherein the inner sash member comprises:

a base housing having a bottom that is elongated and planar;

a top housing fastened to the base housing;

two tubular posts located near lateral ends of the bottom for supporting mounting fasteners, wherein the two tubular posts are connected to the base housing;

an upright front wall with an elongated aperture and connecting side and rear walls encircling the bottom, wherein the upright front wall is connected to the base housing;

a button block extending laterally having a beveled surface and two opposite end tunnels fit snugly over the two tubular posts for maintaining linear translation perpendicular to the moving direction of the plunger, wherein the button block slides relative to the base housing;

a plunger slidably supported in the base housing to move linearly when biased by the beveled surface of the button block, wherein the plunger has a beveled lip portion;

a cam surface engaging the beveled surface of the button block, wherein the button block is aligned to engage the cam surface and bias the plunger, wherein the cam surface is connected to the plunger, wherein the plunger slides relative to the base housing;

two holes formed in the bottom of base housing located at both sides of the aperture;

wherein the outer sash member is a bracket that comprises:

a strike plate extending in parallel with the front wall of base housing, wherein the strike plate is supported by a pair of legs, wherein the pair of legs are connected to the keeper;

a double catch shaped to hook in the two holes, wherein the double catch is connected to the pair of legs;

a beveled surface at a distal edge of the strike plate to engage the beveled lip portion of the plunger when the plunger rides over the strike plate;

a keeper at a proximal edge of the plate; and a rectangular notch formed between the pair of legs into which the plunger protrudes.

2. The sash lock of claim 1, further comprising a pair of helical springs held in the base housing and passing under the cam surface, wherein the pair of helical springs is for maintaining a balanced actuation of the button block and plunger.

3. The sash lock of claim 1, wherein the plunger is retained by a cut out formed in the plunger to engage with a complementary guiding member on the top housing.

4. The sash lock of claim 1, wherein the lock is metallic with the fasteners and springs being made of steel and the rest being cast using zinc.

5. The sash lock of claim 1, wherein the button block has a height greater than the surrounding walls of base housing.

6. A sash lock for use with door and window sashes comprising:

an inner sash member sliding in relation to a outer sash member, wherein the inner sash member comprises:

a base housing having a bottom that is elongated and planar;

a top housing fastened to the base housing;

an upright front wall with an elongated aperture and connecting side and rear walls encircling the bottom, wherein the upright front wall is connected to the base housing;

a button block extending laterally having a beveled surface, wherein the button block slides relative to the base housing;

a plunger slidably supported in the base housing to move linearly when biased by the beveled surface of the button block, wherein the plunger has a beveled lip portion;

a cam surface engaging the beveled surface of the button block, wherein the button block is aligned to engage the cam surface and bias the plunger, wherein the cam surface is connected to the plunger, wherein the plunger slides relative to the base housing;

two holes formed in the bottom of base housing located at both sides of the aperture;

wherein the outer sash member is a bracket that comprises:

a strike plate extending in parallel with the front wall of base housing, wherein the strike plate is supported by a pair of legs, wherein the pair of legs are connected to the keeper;

a double catch shaped to hook in the two holes, wherein the double catch is connected to the pair of legs;

a beveled surface at a distal edge of the strike plate to engage the beveled lip portion of the plunger when the plunger rides over the strike plate;

a keeper at a proximal edge of the plate; and a rectangular notch formed between the pair of legs into which the plunger protrudes.

7. The sash lock of claim 6, further comprising a pair of helical springs held in the base housing and passing under the cam surface, wherein the pair of helical springs is for maintaining a balanced actuation of the button block and plunger.

8. The sash lock of claim 6, wherein the plunger is retained by a cut out formed in the plunger to engage with a complementary guiding member on the top housing.

9. The sash lock of claim 6, wherein the lock is metallic with the fasteners and springs being made of steel and the rest being cast using zinc.

10. The sash lock of claim 6, wherein the button block has a height greater than the surrounding walls of base housing.

* * * * *